US012110752B2

(12) United States Patent
Xiao et al.

(10) Patent No.: US 12,110,752 B2
(45) Date of Patent: Oct. 8, 2024

(54) SYSTEM AND METHOD FOR NAVIGATING A DOWNHOLE ENVIRONMENT

(71) Applicant: SAUDI ARABIAN OIL COMPANY, Dhahran (SA)

(72) Inventors: Jinjiang Xiao, Dhahran (SA); Eiman Hassan Al Munif, Saihat (SA); Hattan M. Banjar, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 66 days.

(21) Appl. No.: 18/049,497

(22) Filed: Oct. 25, 2022

(65) Prior Publication Data

US 2024/0133258 A1 Apr. 25, 2024
US 2024/0229585 A9 Jul. 11, 2024

(51) Int. Cl.
*E21B 23/14* (2006.01)
*E21B 17/20* (2006.01)
(Continued)

(52) U.S. Cl.
CPC ..... *E21B 23/14* (2013.01); *E21B 17/20* (2013.01); *E21B 17/206* (2013.01); *E21B 19/22* (2013.01); *E21B 23/001* (2020.05); *E21B 23/08* (2013.01)

(58) Field of Classification Search
CPC ..... E21B 23/08; E21B 23/10; E21B 23/14; E21B 19/008; E21B 17/20; E21B 17/206
See application file for complete search history.

(56) References Cited

U.S. PATENT DOCUMENTS 4,778,553 A * 10/1988 Wood ..... F16L 55/1651 156/289
5,176,207 A * 1/1993 Keller ..... E21B 49/084 166/264

(Continued)

FOREIGN PATENT DOCUMENTS

CN 112415631 A * 2/2021 ..... G01V 9/00
EA 008564 B1 6/2007
WO WO-2022096666 A1 * 5/2022

OTHER PUBLICATIONS

Coad et al.; "Vine Robots: Design, Teleoperation, and Deployment for Navigation and Exploration", IEEE Robotics and Automation Magazine; Sep. 2019; pp. 120-132 (13 pages).

(Continued)

*Primary Examiner* — Robert E Fuller
(74) *Attorney, Agent, or Firm* — Osha Bergman Watanabe & Burton LLP

(57) ABSTRACT

A system for navigating a downhole environment includes a tube body with a flexible material that is formed as a thin-walled tube and a pump that pumps pressured fluid through the tube body. The tube body has at least a section that extends along a horizontal section of a downhole environment by the flexible material pushing out under the pressured fluid. A method for navigating a downhole environment includes providing a tube body with a flexible material which is formed as a thin-walled tube, pumping a first pressure through the tube body to extend the tube body by the flexible material pushing out at a tip of the tube body, and controlling the flexible material to extend the tube body along a horizontal section of a downhole environment.

18 Claims, 4 Drawing Sheets

(51) Int. Cl.

| | |
|---|---|
| ***E21B 19/22*** | (2006.01) |
| ***E21B 23/08*** | (2006.01) |
| *E21B 23/00* | (2006.01) |

(56) References Cited

U.S. PATENT DOCUMENTS

| | | | | |
|---|---|---|---|---|
| 5,816,293 | A * | 10/1998 | Kiest, Jr. | F16L 55/179 264/269 |
| 5,853,049 | A * | 12/1998 | Keller | E21B 43/103 166/380 |
| 6,390,795 | B1 * | 5/2002 | Waring | F16L 55/1651 425/11 |
| 6,497,290 | B1 | 12/2002 | Misselbrook et al. | |
| 8,322,415 | B2 | 12/2012 | Loretz et al. | |
| 10,337,314 | B2 | 7/2019 | Keller | |
| 10,472,931 | B1 * | 11/2019 | Keller | E21B 34/06 |
| 10,954,789 | B2 | 3/2021 | Hawkes et al. | |
| 11,319,783 | B1 * | 5/2022 | Keller | E21B 43/101 |
| 2002/0007945 | A1 | 1/2002 | Neuroth et al. | |
| 2004/0020544 | A1 * | 2/2004 | Kamiyama | F16L 55/265 405/150.1 |
| 2004/0096614 | A1 | 5/2004 | Quigley et al. | |
| 2008/0245536 | A1 | 10/2008 | Stoesz | |
| 2012/0006444 | A1 | 1/2012 | Tupper et al. | |
| 2015/0300164 | A1 | 10/2015 | Frey et al. | |
| 2020/0063514 | A1 | 2/2020 | Sorensen | |
| 2020/0232292 | A1 * | 7/2020 | Keller | E21B 43/105 |
| 2021/0394358 | A1 * | 12/2021 | Ryu | B25J 19/023 |

OTHER PUBLICATIONS

Naclerio et al.; "Soft Robotic Burrowing Device with Tip-Extension and Granular Fluidization", IEEE/RSJ International Conference on Intelligent Robots and Systems (IROS); Oct. 2018 (6 pages).

International Search Report issued in corresponding International Application No. PCT/US2023/035723; mailed Dec. 20, 2023 (6 pages).

Written Opinion of the International Searching Authority issued in corresponding International Application No. PCT/US2023/035723; mailed Dec. 20, 2023 (7 pages).

* cited by examiner

SYSTEM AND METHOD FOR NAVIGATING A DOWNHOLE ENVIRONMENT

BACKGROUND

In the oil and gas industry, reaching certain depths in already completed wells is extremely crucial for applications like well intervention, data acquisition, or well monitoring, etc.

It is known to navigate a downhole environment using a coiled tubing (CT) with the help of tractors. However, current systems have limitations in reaching certain depths, like the horizontal section or open hole in oil and/or gas wells. Accordingly, there exists a need for additional systems and methods for navigating challenging areas in oil and gas wells, especially in the horizontal open-hole section in already-completed wells.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a system for navigating a downhole environment comprising a tube body with a flexible material that is formed as a thin-walled tube, a pump that pumps pressured fluid through the tube body, wherein the tube body has at least a section that extends along a horizontal section of a downhole environment by the flexible material pushing out under the pressured fluid.

In another aspect, embodiments disclosed herein relate to a method for navigating a downhole environment comprising providing a tube body with a flexible material which is formed as a thin-walled tube; pumping a first pressure through the tube body to extend the tube body by the flexible material pushing out at a tip of the tube body; and controlling the flexible material to extend the tube body along a horizontal section of a downhole environment.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
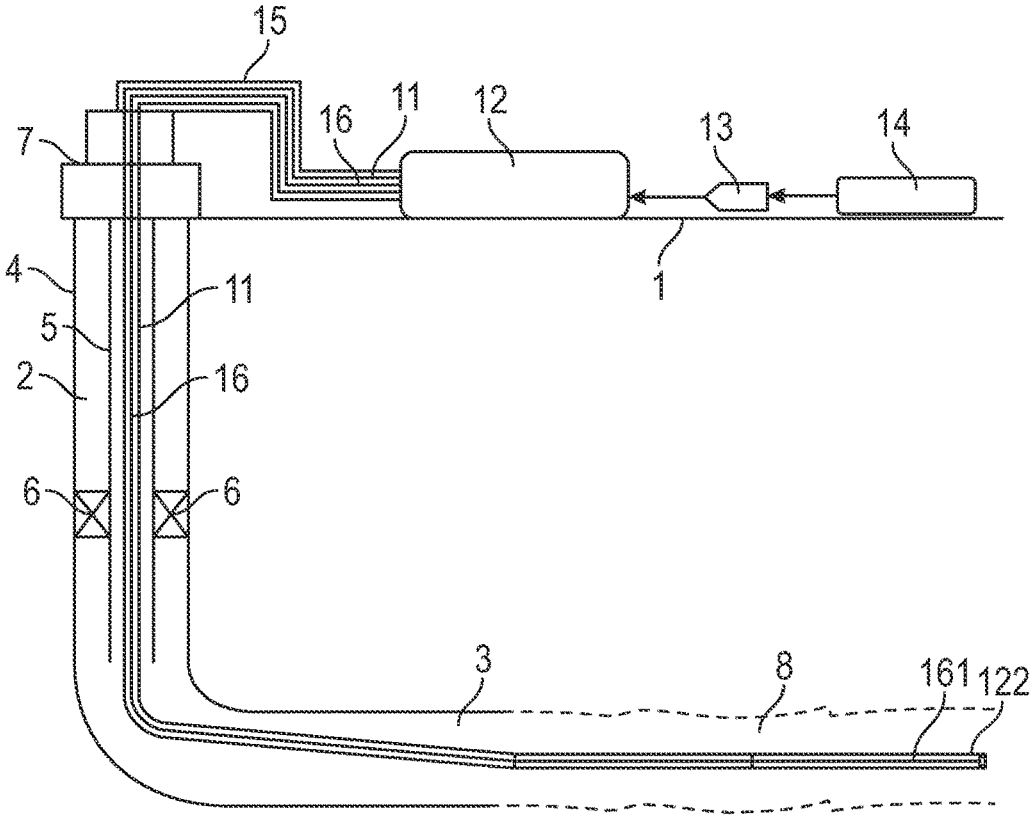
FIG. 1 shows a system for navigating a downhole environment according to one or more embodiments, in which a tube body extends along the downhole environment into the horizontal open-hole section.

In the following detailed description of embodiments of the disclosure, numerous specific details are set forth to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of example, a first element is distinct from a second element, and the first element may encompass more than one element and succeed (or precede) the second element in an ordering of elements.

In the following description of FIGS. 1-7, any component described regarding a figure, in various embodiments disclosed herein, may be equivalent to one or more like-named components described with regard to any other figure. For brevity, descriptions of these components will not be repeated regarding each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a seismic trace" includes reference to one or more of such seismic traces.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowcharts may be omitted, repeated, and/or performed in a different order than the order shown. Accordingly, the scope disclosed herein should not be considered limited to the specific arrangement of steps shown in the flowcharts.

Although multiple dependent claims may not be introduced, it would be apparent to one of ordinary skill that the subject matter of the dependent claims directed to one or more embodiments may be combined with other dependent claims.

As shown in FIG. 1, a downhole environment for oil or gas may comprise a vertical section 2 and a horizontal section (or lateral section) 3 with an inclination usually greater than 80 degrees to the vertical section 2. Meanwhile, as seen in a lateral direction, the downhole environment may comprise a casing 4 at the most outside and a tubing 5 inside the casing 4 with packers 6 in between. A wellhead 7 may be built at the surface 2 above the vertical section 2. At the bottom end of the horizontal section 3, there may be an open-hole section (or borehole section) 8 without casing or tubing, which is usually difficult to reach by currently used means like coiled tubing for applications like well intervention, data acquisition or well monitoring, etc.

In one aspect, embodiments disclosed herein relate to a system for navigating a downhole environment. The system comprises a tube body with thin-walled flexible material and a pump that pumps pressured fluid through the tube body. The tube body has at least a section that extends in a horizontal section of the downhole environment by the flexible material pushing out at a tip of the tube body under the pressured fluid. As will be detailed below, the system is advantageous for navigating a horizontal section of a downhole environment, particularly a horizontal open-hole section of a downhole environment.

One example of a system for navigating a downhole environment is illustrated in FIG. 1, in which a tube body 11 with flexible material 12 is placed at the surface 1 near the wellhead 7 on a truck (not shown). A pump 13 pumps a fluid 14 for example from a tank through the tube body 11 so that the tube body 11 elongates, extends, or grows by the flexible material 12 pushing out at a tip of the tube body under the pressured fluid 14, which will be detailed below. As shown, the tube body 11 may extend from the flexible material 12 along a pipe 15 on the surface 1 and further goes from the wellhead 7 into the vertical section 2 along the tubing 5, and reaches the horizontal section 3, particularly into the horizontal open-hole section 8 of the downhole environment.

The tube body 11 may be partially or wholly formed of flexible material 12. As one example, the tube body 11 may include a hollow base body (not shown) and a flexible material 12, which is formed as a thin-walled tube, coupled to the base body. In another example, the tube body 11 may consist entirely of the flexible material 12.

The flexible material 12 may be formed as a thin-walled tube. Therefore, the flexible material 12 will be compact for storage and may be used as a tube for wire, fluid, or the like in navigating a downhole environment. The flexible material 12 may be chosen from any known material, for example elastomeric synthetic or natural fabric, as long as the material has the property for the expected navigation task. For instance, the flexible material may possess the flexibility to follow tortuous paths, the rigidity to support their own weight while traversing gaps, and the ability to access spaces without movement of the body.

Figure 2:
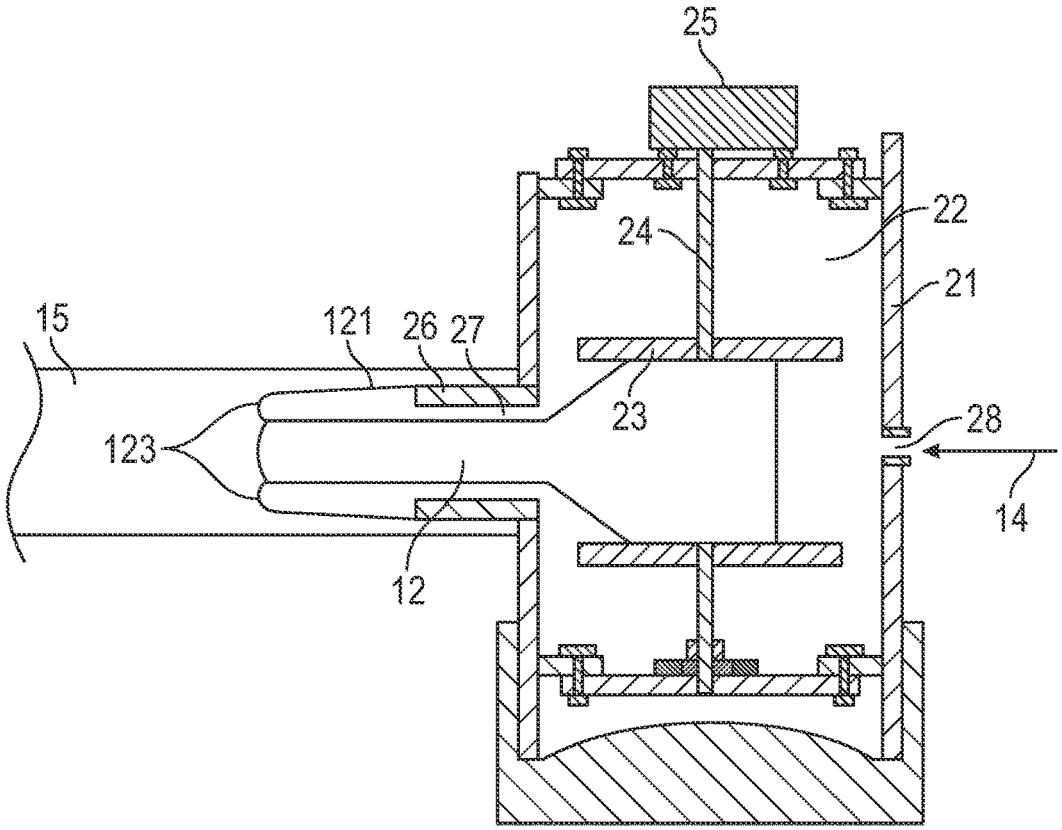
FIG. 2 shows an example of an arrangement of the tube body with a flexible material used with the system of FIG. 1.

An example of the arrangement of the tube body 11 with flexible material 12 is illustrated in FIG. 2. An airtight container 21 is provided with a chamber 22. A spool 23 is supported within the chamber 22 by a shaft 24 which can be driven by a motor 25. The flexible material 12 is disposed in the chamber 22, and a first tube end 121 of the flexible material 11 is coupled to the container via a flange 26 which extends around a first opening 27 in the wall of the chamber 22, and a second tube end 122 (see FIG. 1) of the flexible material 12 is spooled onto the spool 23. The chamber 22 may include a second opening 28 for pressured fluid 14 to be pumped into the chamber 22 from the pump 13 outside of the chamber 22. Alternatively, a pump may be positioned in the chamber and thus the second opening is unnecessary.

In operation, pressured fluid 14 is pumped into the chamber 22 through the second opening 28. Driven by the pressured fluid, the first tube end 121 coupled to the flange 26 will be folded inside itself with a tip 123 extending or reversing out. By means of the motor 25, the shaft 24 turns to unroll the flexible material 12 from the spool 23, allowing a tube body to elongate by the flexible material 12 pushing out at the tip 123 of the tube body under pressure. As mentioned above with reference to FIG. 1, the tube body 11 thus formed from the flexible material 12 may grow and extend along the pipe 15 on the surface 1 and goes from the wellhead 7 into the vertical section 2 and reaches the horizontal section 3.

In particular, the tube body 11 may grow along the horizontal open-hole section 8 of the downhole environment. A horizontal open-hole section is difficult to reach by known means, like coiled tubing, due to the complicated environment. However, the tube body 11 as disclosed may conveniently extend along a horizontal open-hole section of the downhole environment. The tube body 11 as disclosed realizes locomotion by growth, which is also known as vine robot in the art due to its similar behavior to plants with the growth habit of trailing. Due to this growth-based movement, the tube body 11 is advantageous for navigating a horizontal section of a downhole environment, particularly a horizontal open-hole section of a downhole environment. For example, there is firstly little sliding friction between the growing body and its surroundings. Second, the pump as driving source can be stationary outside of the downhole environment on the surface. Finally, a growing body does not need to apply forces to its immediate environment to move along the downhole environment and, instead, can exploit contacts more proximal on the body.

In addition to the above, more features can be used with the arrangement as shown in FIG. 2. For instance, elements may be included so that the tube body self-orients and conforms to the passage of the wellbore as it grows by reversing out.

Now referring once again to FIG. 1, a rope 16 may be provided for the tube body 11. It can be appreciated, though not shown in the figure, that a first rope end of the rope 16 may extend from a second tube end 122 (see FIG. 1) of the flexible material 12 and a second rope end of the rope is spooled onto the spool 23. After the whole length of the flexible material 12 is unrolled from the spool 23, the rope 16 will be in turn unrolled from the spool 23 to control the growth of the tube body 11 along the downhole environment. To pull out the tube body 11 from the downhole environment, the motor 25 oppositely drives the shaft 24 such that the flexible material 12 will be rolled onto the spool 23. In case that a rope 16 is arranged as in FIG. 1, the rope 16 can be driven by the motor 25 and the shaft 24 to spool onto the spool 23, pulling and spooling the flexible material 12 back to its original state onto the spool 23.

For navigating and sensing the downhole environment, the tube body may include a fiber optical cable and one or more sensors. The fiber optical cable may be arranged along the tube body, and sensors may be embedded in the flexible material and connected to the fiber optical cable. As the tube body extends along the downhole environment, communication is thus provided from downhole environment to above the surface for well intervention, monitoring, and other operations.

The fluid 14 may be any kind of fluid like gas, liquid, or others as appropriate. In one example, a fluid is provided for well intervention or stimulation. As such, a burst disk may be provided in the flexible material. After the tube body extends to the targeted position in the horizontal open-hole downhole environment, the fluid may be pumped with a higher pressure to open the burst disk and then the fluid for well intervention or stimulation can be pumped out into the downhole environment.

Figure 3:
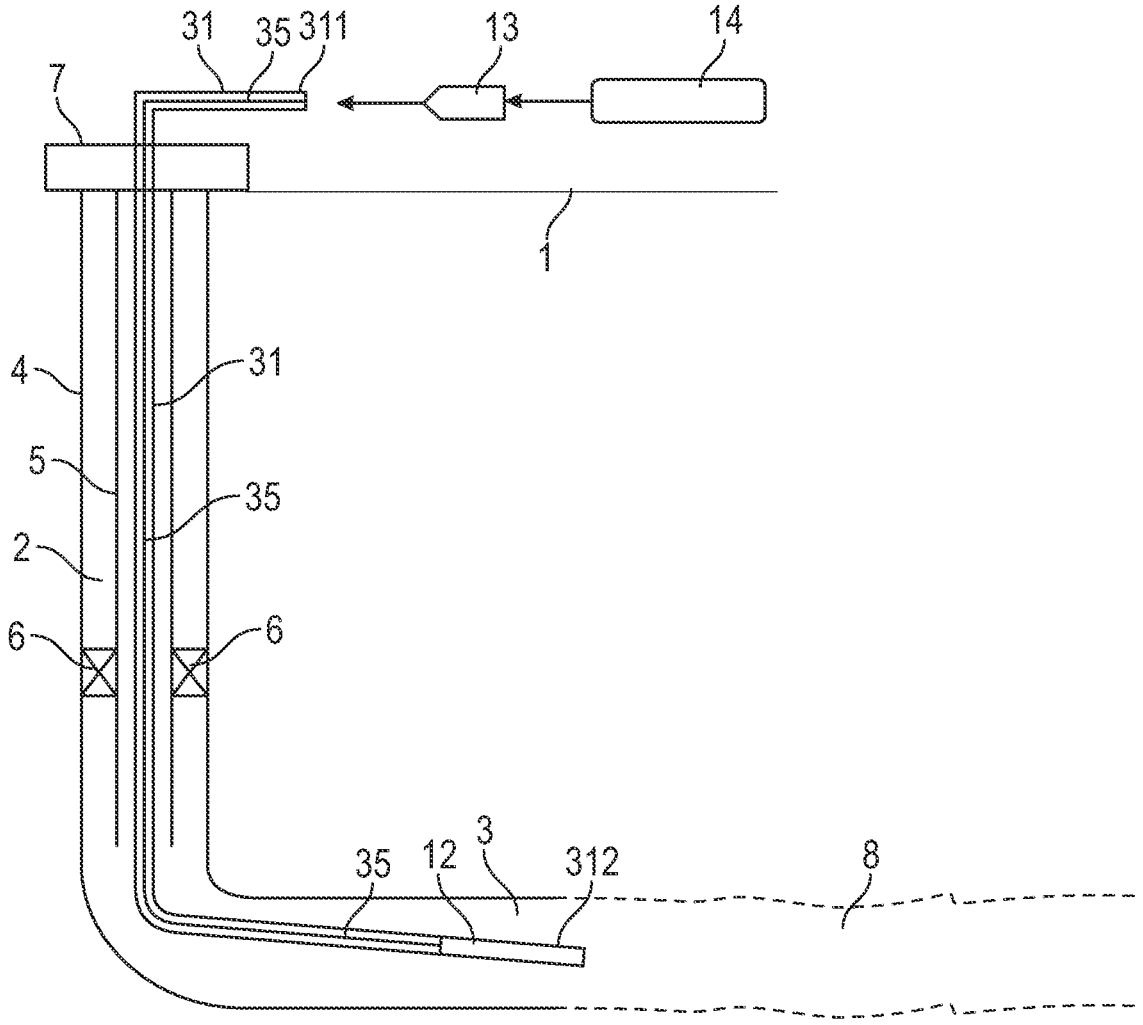
FIG. 3 shows another system for navigating a downhole environment according to one or more embodiments, in which a coiled tubing is set along the downhole environment and a flexible material is compressed and encased inside the coiled tubing.

Another example of a system for navigating a downhole environment is illustrated in FIG. 3. The system includes a coiled tubing 31 which may be arranged at the surface 1 near the wellhead 7 on a coiled tubing truck (not shown). A first tubing end 311 of the coiled tubing 31 is configured to be coupled to a pump 13 on the surface 1, and a second tubing end 312 of the coiled tubing 31 is configured to be set via known means into the downhole environment. A flexible material 12 formed as a thin-wall hollow tube is compressed and encased inside the coiled tubing 31 adjacent the second tubing end 312. A pump 13 pumps a fluid 14 from a tank through the coiled tubing 31 so that the flexible material 12 pushes out under the pressured fluid, which will be detailed below.

A coiled tubing is known in the art as a long continuous string of tubing spooled on a reel. Coiled tubing can be straightened prior to being inserted into the wellbore and recoiled to spool back on the reel later. A coiled tubing is used normally with other parts like an injector head, a coiled tubing reel, a control cabin, a power pack, and well control equipment. An injector head is used to provide the driving force to push and pull the coiled tubing in and out of the well bore during operations. A coiled tubing reel is mainly used to store and transport the coiled tubing during application. A control cabin refers to a place where an operator monitors and manipulates the coiled tubing to ensure the proper function. A power pack is a device used to offer the hydraulic power needed for the operation.

The flexible material may be arranged in any appropriate form in the coiled tubing. As one example, the flexible material is folded inside itself many times. As a further example, the flexible material is folded onto itself many times. In any of the forms of the flexible material in the coiled tube, it may be preferred that a tube will grow out of the coiled tube from the flexible material along the downhole environment. As such, a grown tube may enhance the reach of the coiled tubing, but more importantly, be advantageous for navigating a horizontal section of a downhole environment, particularly, an open-hole horizontal section of the downhole environment.

Figure 4:
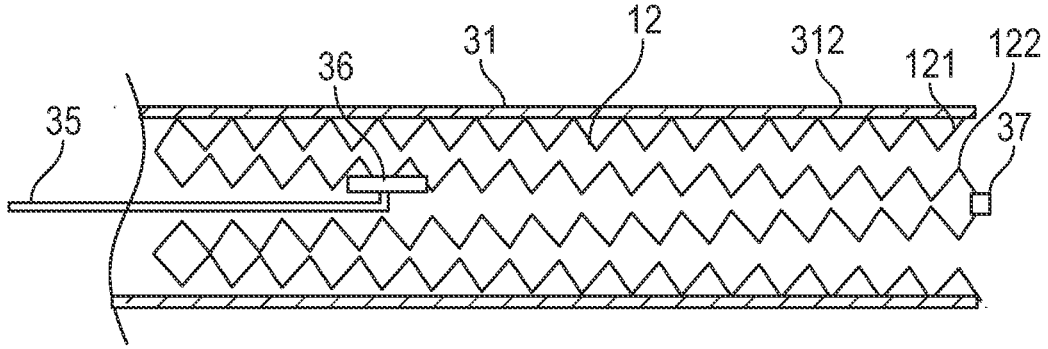
FIG. 4 shows an example of an arrangement of the flexible material in the coiled tube used with the system of FIG. 3.

An exemplary arrangement of the flexible material 12 in the coiled tube 31 is shown in FIG. 4. The flexible material 12 is formed as a corrugated tube and folded inside itself in the coiled tube 31. A first tube end 121 of the corrugated flexible material 12 is coupled to the second tubing end 312 of the coiled tubing 31. A second tube end 122 of the corrugated flexible material 12 is closed and displaced near the terminal of the second tubing end 312. Though the corrugated flexible material is shown in the figure as folded inside itself once, this is only schematic, and the flexible material may not be corrugated or may be folded as many times as possible according to actual circumstances.

For navigating and sensing the downhole environment by the system, a fiber optical cable 35 and sensors 36 may be provided. As shown in FIG. 4, a fiber optical cable 35 may be arranged along the coiled tubing, and one or more sensors 36 may be embedded in the flexible material 12 and connected to the fiber optical cable 35. Moreover, a burst disk 37 may be provided in the flexible material. By pumping the coiled tubing at a pressure high enough to open the burst disk 37, the fluids for well intervention or stimulation can be pumped into the downhole environment.

Though not shown in the figures, it is appreciated from the discussion above that the flexible material may be arranged inside the coiled tubing with a first tube end of the flexible material coupled to the coiled tubing and a second tube end fastened to a rope which runs out of the coiled tubing on the surface. In this case, the rope may include a fiber optical cable which is connected to sensors embedded in the flexible material.

Figure 5:
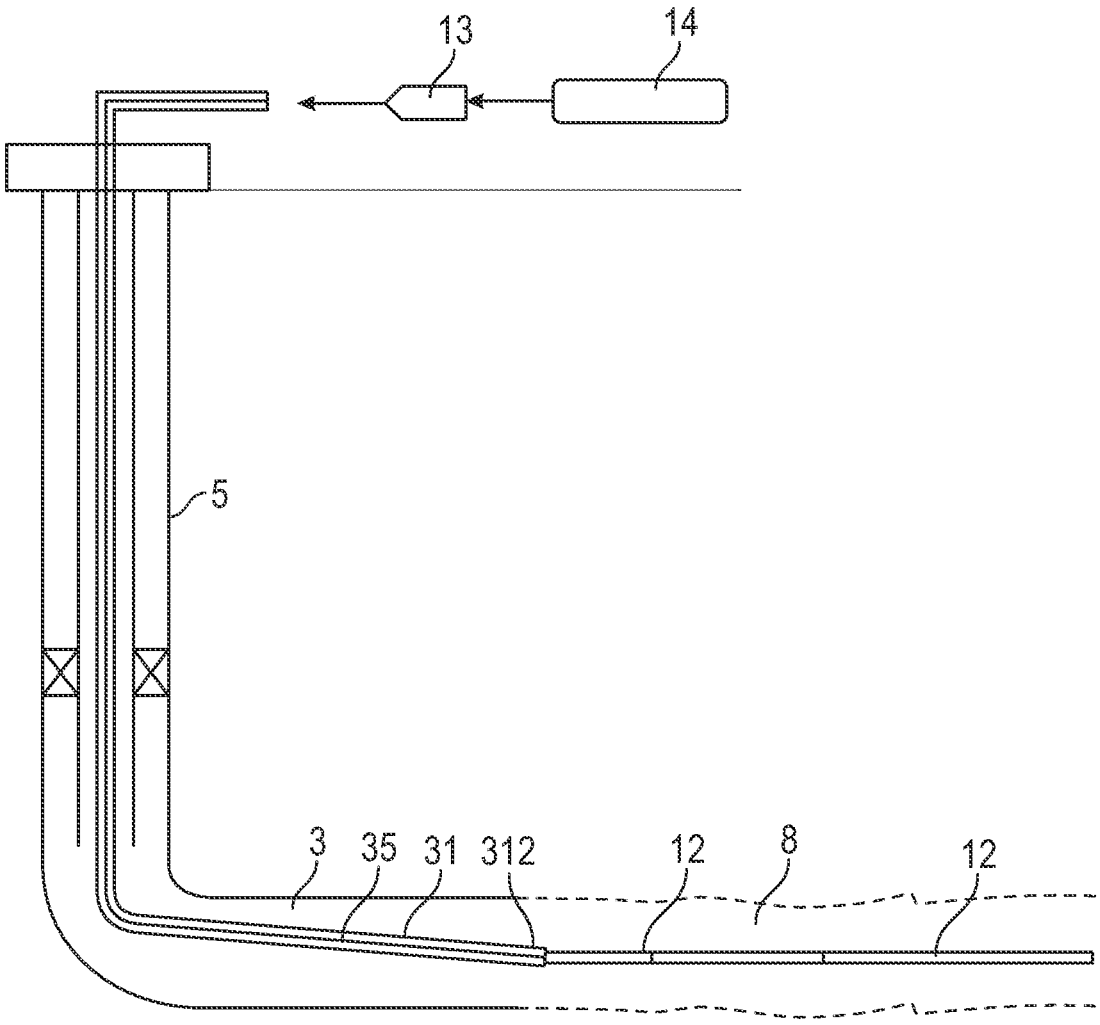
FIG. 5 shows the system of FIG. 3, in which the flexible material pushes out of the coiled tubing along a horizontal open-hole section.

In operation, the coiled tubing 31 is extended along the downhole environment with other parts like an injector head, a coiled tubing reel, a control cabin, a power pack, and well control equipment. After reaching the target depth in horizontal section 3 of the downhole environment, the coiled tube is stopped and locked up, and a fluid 14 is pumped into the coiled tubing 31. Under the pressure of the pumped fluid, the flexible material inside the coiled tube will be pushed out in the form of a tube along the wellbore, particularly along an open-hole, as shown in FIG. 5. Thus, the coiled tubing elongates, extends, or grows by the flexible material pushing out under the pressured fluid, and communication is thus provided from downhole environment to above the surface via the sensors and the fiber cable.

Though not shown in the figures, well control equipment may also be a part of the system. For example, a ram blowout preventer (BOP) may be set on top of the wellhead when the operation is in a live well condition, in which the well will be in underbalanced condition most of the time. The ram type may be "shear", and its function is to shear or cut the tube body in case of emergency to shut the well in and secure it.

In another aspect, embodiments disclosed herein relate to a method for navigating a downhole environment. The method comprises providing a tube body with a flexible material which is formed as a thin-walled tube, pumping a first pressure through the tube body to extend the tube body by the flexible material pushing out at a tip of the tube body, and controlling the flexible material to extend the tube body along a horizontal section of a downhole environment.

Figure 6:
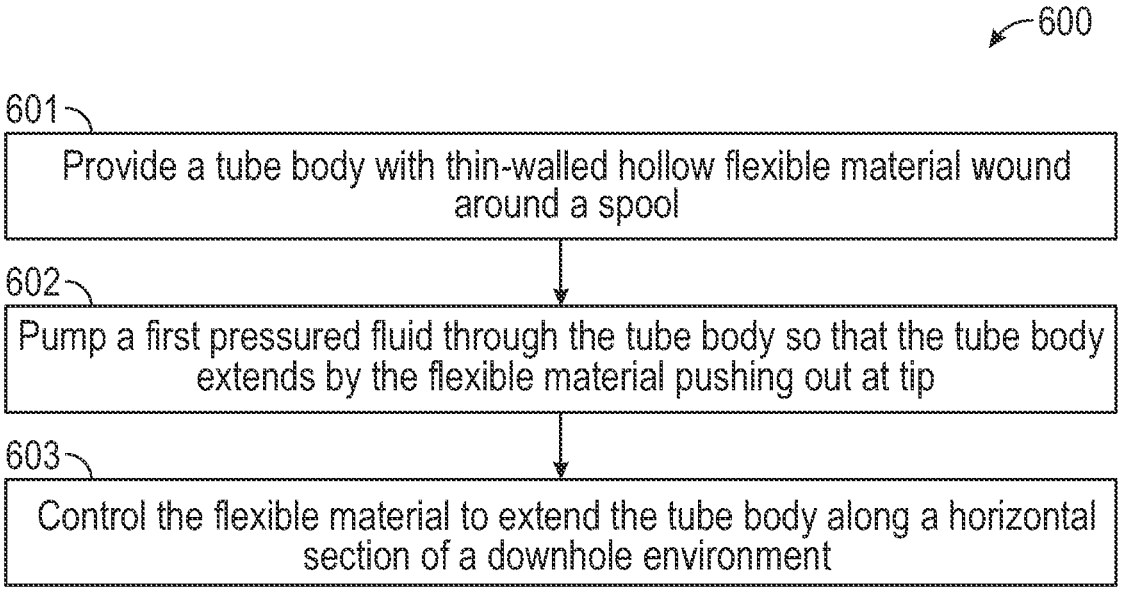
FIG. 6 shows a flowchart of a method for navigating a downhole environment according to one or more embodiments.

One example of a method for navigating a downhole environment is shown with a flowchart 600 in FIG. 6.

Step 601 provides a tube body with thin-walled hollow flexible material wrapped around a spool.

As an example, the tube body with flexible material may be placed at a surface near a wellhead on a truck and be arranged as illustrated in FIG. 2. An airtight container is provided with a chamber. A spool is supported in the chamber by a shaft which can be driven by a motor. The flexible material of the tube body is disposed in the container, and a first tube end of the flexible material is coupled to the container via a flange which extends around a first opening from the wall of the chamber, and a second tube end is wrapped around the spool. A second opening may be provided for pressured fluid to be pumped into the chamber.

Step 602 pumps a first pressured fluid through the tube body so that the tube body extends by the flexible material pushing out at a tip of the tube body.

As discussed above with reference to FIG. 2, a pump feeds pressured fluid from a fluid tank into the chamber, and the first tube end which is coupled to the flange will be folded inside itself with a tip extending out of the chamber under pressured fluid. By means of the motor, the shaft turns to unroll the flexible material from the spool, allowing the tube to elongate from the tip.

Step 603 controls the flexible material to extend the tube body along a horizontal section of a downhole environment.

It is appreciated that the length of the tube body which extend into a downhole environment is controlled by flexible material unwrapped from the spool. That is, the extended length of the tube body is limited by the amount of material wrapped around the spool. Therefore, by controlling the motor in the example of FIG. 2, the tube body in the downhole environment is controlled. As such, the tube body may grow from the container and extend along a pipe on the surface and goes from the wellhead into the vertical section and the horizontal section. In particular, the tube body may grow along the open-hole horizontal section of the downhole environment, as illustrated in FIG. 1.

In one example, a rope can be provided to assist control the flexible material and the length of the tube body in the downhole environment. A first rope end of the rope may be fastened to the second tube end of the flexible material and a second rope end of the rope is fastened to the spool and wrapped around the spool. After all of the flexible material is unrolled from the spool, the rope will be unrolled from the spool under the drive of the motor to control the growth of the tube body. In order to pull out the tube body from the downhole environment, the motor oppositely drives the shaft such that the flexible material will be rolled onto the spool. In the case of a rope fixed to the flexible material, the spool turns to roll the rope which in turn retracts the flexible to this original setup in the spool.

After the tube body is set at the targeted depth, for instance in an open-hole horizontal section of the downhole environment, an operation of navigation of the downhole environment can be performed. For example, information on the open-hole horizontal section can be collected via a fiber optical cable which runs along the tube body from a sensor which is embedded in the flexible material.

Figure 7:
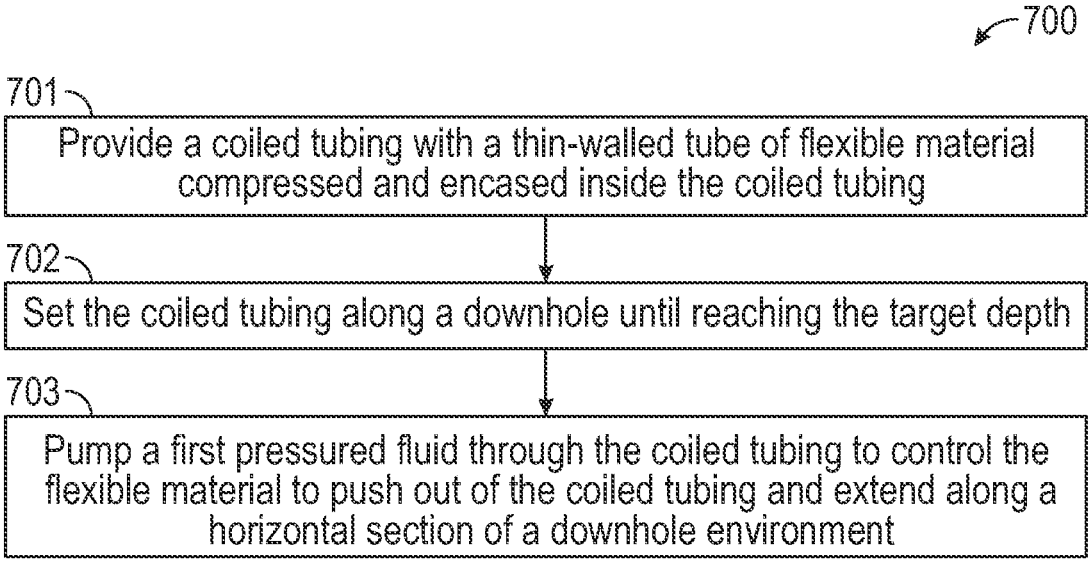
FIG. 7 shows a flowchart of another method for navigating a downhole environment according to one or more embodiments.

Another example of a method for navigating a downhole environment is shown with a flowchart 700 in FIG. 7.

Step 701 provides a coiled tubing with a thin-walled tube of flexible material compressed and encased inside the coiled tubing.

The coiled tubing with flexible material can be arranged as shown and discussed above with reference to FIGS. 3-4. That is, the coiled tubing can be arranged at a surface near the wellhead on a coiled tubing truck, and the flexible material may be formed as a thin-wall hollow tube body and compressed and encased inside the coiled tubing adjacent the second end.

A coiled tubing is known in the art as a long continuous string of tubing spooled on a large reel. Coiled tubing can be straightened prior to being inserted into the wellbore and recoiled to spool back on the reel later. A coiled tubing is used normally with other parts like an injector head, a coiled tubing reel, a control cabin, a power pack, and well control equipment. An injector head is used to provide the driving force to push and pull the coil in and out of the well bore during operations. A coiled tubing reel is mainly used to store and transport the coiled tubing during application. A control cabin refers to a place where the operators monitor and manipulate the coiled tubing to ensure the proper function. A power pack is a device used to offer the hydraulic power needed for operation.

The flexible material may be arranged in any appropriate form in the coiled tubing. As one example, the tube body may include a hollow base body connected with the coiled tube and a flexible material which forms as thin-walled tube and is coupled to the base body. In another example, the tube body consists entirely of flexible material, which is formed as a hollow tube. As a further example, the flexible material is folded inside itself many times. As a further example, the flexible material is folded onto itself many times.

Step 702 sets the coiled tubing along a downhole environment until reaching a target depth.

The coiled tubing may be extended along the downhole environment with parts like an injector head, a coiled tubing reel, a control cabin, a power pack, and well control equipment. After reaching the target depth in the downhole environment, the coiled tube is stopped pushing and locked up. As illustrated in FIG. 3, the coiled tube may run along the downhole environment until near the beginning of the open-hole section.

Step 703 pumps a first pressured fluid through the coiled tubing to control the flexible material to push out of the coiled tubing and extend along a horizontal section of a downhole environment.

Under the pressure of the pumped fluid, the flexible material inside the coiled tube will be pushed out along the horizontal section of the downhole environment. In particular, the flexible material may extend as a tube along an open-hole horizontal section of the downhole environment, as shown in FIG. 5.

By means of the fiber optical cable arranged along the tube body and sensors embedded in the flexible material and connected to the fiber optical cable, communication is thus provided from downhole environment to above the surface for well intervention, monitoring, and other operations.

Advantageously, by pumping the coiled tubing into a higher pressure to open the burst disk at the flexible material, the fluids for well intervention or stimulation can be pumped.

While the disclosure has been described with respect to a limited number of embodiments, those skilled in the art, having benefit of this disclosure will appreciate that other embodiments can be devised which do not depart from the scope of the disclosure. Accordingly, the scope of the disclosure should be limited only by the attached claims.

What is claimed is:

1. A system for navigating a downhole environment comprising:

a tube body with a flexible material that is formed as a thin-walled tube, wherein the tube body includes a coiled tubing configured to be coupled to the pump on a first tubing end of the coiled tubing, and the flexible material is initially compressed and encased inside the coiled tubing, and a pump that pumps pressured fluid through the tube body, wherein the tube body has at least one section that extends along a horizontal section of the downhole environment by the flexible material pushing out from the coiled tubing under the pressured fluid.

2. The system according to claim 1, wherein the horizontal section of the downhole environment is an open-hole section.

3. The system according to claim 1, further comprising:

a container with a chamber, and a spool in the chamber, wherein the flexible material is disposed in the chamber, and a first tube end of the flexible material is coupled to the container via a flange which extends around a first opening of the chamber and a second tube end of the flexible material is wrapped around the spool.

4. The system according to claim 3, further comprising:
a rope which extends from the second tube end of the flexible material and wraps around the spool.

5. The system according to claim 1,
wherein a first tube end of the flexible material is coupled to the coiled tubing and a second tube end of the flexible material is closed.

6. The system according to claim 1,
wherein the flexible material includes a burst disk which opens under a designated pressure from the pump.

7. The system according to claim 1,
wherein the flexible material is formed as a corrugated tube and folded inside itself multiple times along the coiled tubing.

8. The system according to claim 1, further comprising
a fiber optical cable along the tube body.

9. The system according to claim 8, further comprising
a sensor embedded in the flexible material and connected to the fiber optical cable.

10. A method for navigating a downhole environment comprising:
providing a tube body with a flexible material which is formed as a thin-walled tube, wherein the tube body includes a coiled tubing configured to be coupled to a pump by a first tubing end of the coiled tubing, and the flexible material is initially compressed and encased inside the coiled tubing;
pumping a first pressure through the tube body to extend the tube body by the flexible material pushing out from the coiled tubing at a tip; and
controlling the flexible material to extend the tube body along a horizontal section of the downhole environment.

11. The method according to claim 10,
wherein the horizontal section of the downhole environment is an open-hole section.

12. The method according to claim 10,
wherein the flexible material is disposed in a chamber of a container, and a first tube end of the flexible material is coupled to the container via a flange which extends around a first opening of the chamber, and a second tube end of the flexible material is wrapped around a spool.

13. The method according to claim 12,
wherein a rope extends from the second tube end of the flexible material and wraps around the spool.

14. The method according to claim 10,
wherein a first tube end of the flexible material is coupled to a second tubing end of the coiled tubing and a second tube end of the flexible material is closed.

15. The method according to claim 10,
wherein the flexible material is formed into a corrugated tube and folded inside itself multiple times along the coiled tubing.

16. The method according to claim 10, further comprising
collecting information via a fiber optical cable which runs along the tube body from a sensor which is embedded in the flexible material.

17. The method according to claim 10, further comprising
pumping a fluid with a second pressure higher than the first pressure through the tube body to open a burst disk at the flexible material.

18. The method according to claim 10,
wherein at least one section of the tube body extends by the flexible material reversing out of the thin-walled tube along an open-hole horizontal section of the downhole environment.

* * * * *